US005925195A

United States Patent [19]

King et al.

[11] Patent Number: 5,925,195

[45] Date of Patent: Jul. 20, 1999

[54] PORTABLE DIP CLEANING SYSTEM

[76] Inventors: Paul King, 1249 McNeilly Ave., Pittsburgh, Pa. 15216; Donald Ish, 109 Sampson Ave., Pittsburgh, Pa. 15205

[21] Appl. No.: 08/686,394

[22] Filed: Jul. 25, 1996

[51] Int. Cl.[6] ..... B08B 7/00

[52] U.S. Cl. ..... 134/19; 134/570

[58] Field of Search ..... 134/19, 570

[56] References Cited

U.S. PATENT DOCUMENTS 5,368,649 11/1994 Tsukazaki ..... 134/1

*Primary Examiner*—Edward J. Cain

*Attorney, Agent, or Firm*—Titus & McConomy LLP

[57] ABSTRACT

The present invention relates generally to an apparatus and process for liquid immersion natural convection chemical cleaning of industrial and/or household items and in particular to an apparatus and process for cleaning dishware. The invention provides an apparatus for removing foreign substances from a surface through contact with a heated liquid cleaning solution circulating by natural convection. A preferably stainless steel tank holds the cleaning solution and the articles to be cleaned. The tank has at least one electrical heating element preferably energized by a thermostat regulated electrical control system to maintain the temperature of said cleaning solution at a value lying within a predetermined range for a predetermined time period which have both experimentally been proven to provide optimum cleaning results. The cleaning solution comprises a mixture of water and an alkalike non-toxic solution containing no organic solvents.

16 Claims, 1 Drawing Sheet

PORTABLE DIP CLEANING SYSTEM

FIELD OF THE INVENTION

The present invention relates generally to an apparatus and process for liquid immersion natural convection chemical cleaning of industrial and/or household items and in particular to an apparatus and process for cleaning cookware.

BACKGROUND OF THE INVENTION

Many different articles of manufacture, chemical compositions and processes have been developed for removing foreign substances from the surfaces of industrial and/or household items, including cookware and dishware, through liquid chemical cleaning processes. A common undesirable feature of these prior art inventions is the requirement for externally induced agitation to initiate the chemical cleaning process. This results in a significant increased cost required for agitation due to consequential equipment breakdowns, ultimately driving up the cost of such inventions to the user.

The present invention provides an apparatus and process for liquid immersion natural convection chemical cleaning ("dip cleaning") of industrial and/or household items without externally induced sources of liquid agitation. The items to be cleaned are immersed in a tank filled with a cleaning solution preferably comprising water and an alkaline non-toxic degreaser containing no organic solvents. The cleaning solution is electrically heated to a value lying within a predetermined temperature range for a predetermined time period to provide optimum cleaning results. Cleaning is accomplished by natural heating induced convection requiring no mechanical agitation. The cleaning solution is naturally circulated to flow underneath a grated tank bottom where it is electrically heated. The heated cleaning solution convects upwardly forming a natural circulation system which cleans by the natural circulation flow of the cleaning solution over the surfaces of the articles to be cleaned. The present invention is particularly well suited for use in cleaning cookware in the home and in commercial restaurant establishments.

Accordingly it is an object of the present invention to provide an apparatus and process for liquid immersion natural convection chemical cleaning of industrial and/or household items without externally induced sources of liquid agitation.

It is also an object of the present invention to provide an apparatus and process for liquid immersion natural convection chemical cleaning of cookware and dishware without externally induced sources of liquid agitation.

SUMMARY OF THE INVENTION

The present invention provides an apparatus for removing foreign substances from a surface through contact with a heated liquid cleaning solution circulated preferably by natural convection. A tank, preferably stainless steel, holds the cleaning solution and the articles to be cleaned. The tank has at least one heating element preferably energized by a thermostat regulated control system to maintain the temperature of said cleaning solution within a predetermined range for a predetermined time period to provide optimum cleaning results. The preferred cleaning solution comprises a mixture of water and an alkaline non-toxic degreaser containing no organic solvents.

The cleaning process includes the steps of: (1) formulating the cleaning solution by forming a mixture preferably having a ratio of substantially 48 to 67 parts water to one part cleaning solution; (2) immersing the articles to be cleaned in the solution; (3) heating the cleaning solution to a value lying within the predetermined temperature range; and (4) holding said cleaning solution within the predetermined temperature range for the predetermined time period. The predetermined temperature range requires heating the cleaning solution to a value substantially within the range of 140° F. to 180° F. surrounding a preset thermostat setpoint fixed at 170° F. The predetermined time period for maintaining the cleaning solution at or near the temperature setpoint has been experimentally determined to lie substantially within the range of one minute to twelve hours, and is more preferably is substantially four hours for cleaning solution volumes of approximately 100 gallons and cleaning temperatures in the vicinity of 170° F.

It is understood that times, temperatures and concentrations may vary depending upon the nature of the items to be cleaned. For example, certain industrial components may require a higher concentration of solution and/or a longer time to effect the desired cleaning or degreasing. Additionally, in certain applications where the time required to effect cleaning is critical a small pump may be added to increase the flow rates. Other advantages of the present invention will become apparent from a perusal of the following detailed description of a presently preferred embodiment taken in connection with the accompanying drawings.

BRIEF DESCRIPTION OF THE DETAILED DRAWINGS

DETAILED DESCRIPTION OF THE PREFERRED EMBODIMENT

Figure 2:
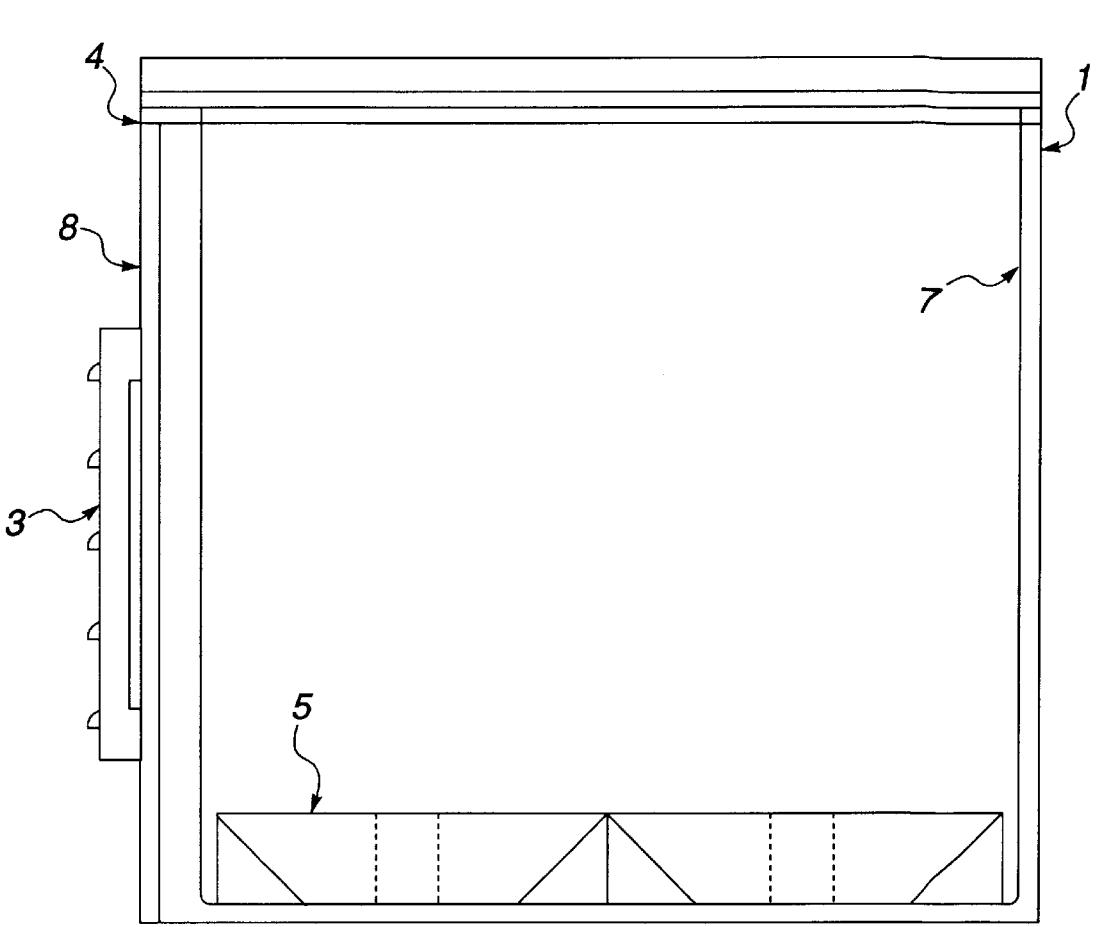
FIG. 2 is a lengthwise cross-sectional view of the preferred embodiment of the apparatus of the present invention.
Figure 1:
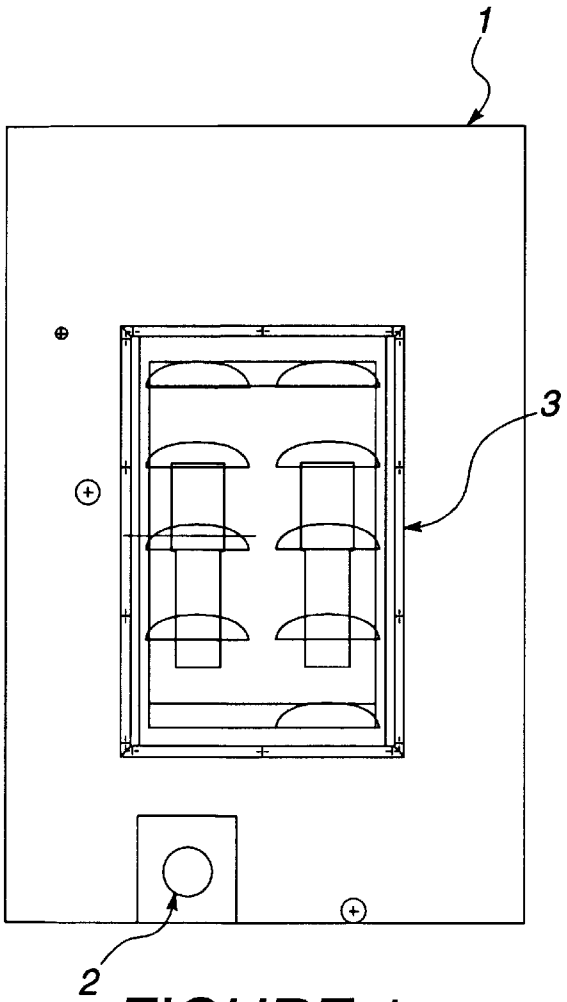
FIG. 1 is a side view of the preferred embodiment of the apparatus of the present invention.

Referring to FIGS. 1 and 2, the dip cleaning process of the present invention is preferably accomplished in an insulated portable cleaning tank 1. Where the system is used for cleaning cookware and dishware, the tank is preferably made of a ceramic or a metal such as stainless steel or other similar National Sanitation Foundation (NSF) approved materials. Tank 1 is preferably comprised of a sink 7 holding the articles to be cleaned and the cleaning solution surrounded by a shell 8 that encloses heating control system wiring and approximately ⅝ inch thick insulation preferably made of styrofoam or polyurethane. Sink 7 has an inner surface of seamless welded construction and an outer edge 4 welded to the shell 8 and including an optional silicone seal. The sink 7 of the preferred embodiment is designed to hold a minimum cleaning solution fill volume of 55 gallons and has maximum capacity of approximately 100 gallons, however use of the invention is not limited to any particular tank size.

Tank 1 contains a heating system, preferably electrical and comprised of one or more conductive metal heating elements 2 located beneath the bottom grated surface 5 of the tank 1 and energized by an electrical controller 3 mounted to a sidewall of the tank 1. For example, in a system used for cookware, two 2500 watt heating elements 2 (A. O. Smith Model No. 23791-6) and a thermostat regulated limit switch electrical controller 3 (A. O. Smith Model Nos. 38008 and 38017, respectively) are used in the preferred embodiment, but any electrical controller having an adjustable temperature setpoint can be used to control the cleaning solution temperature inside the tank 1. Electrical controller 3 will energize and deenergize the heating elements 2 such that the tank temperature is maintained within approximately 25° F. (degrees Fahrenheit) of the operator-selected setpoint.

In cookware cleaning operations, the setpoint is preferably set at a temperature near 170° F., but any setpoint approximately within the 140° F.–180° F. temperature range will produce satisfactory results. The electrical controller 3 will maintain the temperature of the cleaning solution within the setpoint control band so long as a timer connected to the electrical controller 3 is activated. A spring wound timer (Intermatic Grainger Model No. 6X547) is used in the preferred embodiment, but any conventional electronic or mechanical clock timer can be used.

In operation, the tank 1 is loaded with the articles to be cleaned with the tank drain valve closed. The articles to be cleaned can be made of any ceramic, metallic, rubber, plastic or polymeric substance, or of wood, cement, brick, mortar, stone or other similar materials. The dip cleaning system of the present invention is preferably used to clean cookware and dishware soiled with food waste, but will work with similar effectiveness in cleaning other industrial and household articles made of the materials described above.

In the preferred embodiment for use in cleaning heavily soiled cookware, after the tank 1 is loaded with the articles to be cleaned, it is filled with a liquid cleaning solution comprised of water and an alkaline non-toxic degreaser containing no organic solvents. Moreover, the degreaser is added to room temperature tap water in a ratio of approximately 48–67 parts water to one part degreaser. Optimum cleaning results are preferably achieved with a water to degreaser ratio of approximately 60 parts water to one part degreaser. Spartan Chemical Co. type SNB-130 degreaser is used in the preferred embodiment.

After the liquid cleaning solution is added to the tank 1, the temperature controller 3 is set to a temperature within the preferred range and the timer is set to a time out value that will encompass the heating and holding times required to complete the cleaning cycle. The tank 1 is heated at atmospheric pressure until the setpoint temperature is reached and thereafter the cleaning solution is maintained substantially within 25° F. of the setpoint until the cleaning cycle is completed. Typical heating times lie within the range of approximately five to six hours when a tank of the preferred capacity is filled with approximately 100 gallons of the cleaning solution at room temperature. A correspondingly longer or shorter heating time would result if a larger or smaller cleaning solution volume is used or if the cleaning solution is heated from a temperature cooler or warmer than room temperature, respectively. The cleaning solution is typically maintained near the setpoint temperature for a period of approximately four hours. A correspondingly longer or shorter holding time would result for a larger or smaller cleaning solution volume or if the temperature setpoint were adjusted to a temperature below or above the preferred 170° F. value, respectively. Experimentation has shown that a holding time of one minute up to approximately twelve hours will yield satisfactory cleaning results, depending on the material composition of the surface to be cleaned, the extent of cleaning required, the temperature, concentration and volume of cleaning solution, and depending on whether a pump is used to increase cleaning solution flow rate.

Cleaning is accomplished by natural heating-induced convection requiring no mechanical agitation. The cleaning solution is naturally circulated to flow underneath the grated tank bottom 5 where it is heated by the heating elements 2. The heated cleaning solution is then forced upward toward the top of the tank 1 by the cooler unheated cleaning solution above the grated tank bottom 5 thereby forming a natural circulation system which accomplishes cleaning by the convection-induced flow of the cleaning solution over the surfaces of the articles to be cleaned. After the cleaning solution has been held at the setpoint temperature for the required length of time the tank 1 is allowed to cool a temperature which will allow manual removal of the cleaned articles. Cooling times may range from approximately 7 to 14 hours. To allow reuse of the cleaning solution the articles can be removed without draining the tank 1 or alternately the drain valve can be opened to allow the cleaned articles to dry before removal. A non-preferred method of cleaning is accomplished by utilizing a pump to circulate the cleaning solution over the surfaces of the articles to be cleaned thereby adding to the natural convection flow rate to reduce overall cleaning time.

The dip cleaning system of the present invention has been shown to completely dislodge hard to remove foreign substances, such as food soils and other organic, oil and water based compounds from the surfaces of industrial and household articles, particularly cookware and dishware, without the use of any type of externally induced liquid agitation. Thus the present invention requires no replacement of worn out moving parts and thus reduces the overall expense required to clean heavily soiled items used in a variety of industrial and household applications.

While presently preferred embodiments of the invention have been shown and described in particularity, the invention may be otherwise embodied within the scope of the appended claims.

What is claimed is:

1. An apparatus for cleaning substances from articles having at least one surface comprising:

A. a heated liquid cleaning solution contacting said surface through circulation by at least natural convection;

B. a tank for holding said cleaning solution and said articles;

C. at least one heat source in contact with said tank; and

D. a control system for controlling said heat source to maintain the temperature of said cleaning solution at a value lying within a predetermined range for a predetermined time period.

2. The apparatus of claim 1, wherein said cleaning solution comprises water mixed with an alkaline non-toxic chemical cleaning agent containing no organic solvents.

3. The apparatus of claim 2, wherein said cleaning solution comprises about 48 to 67 parts water to one part chemical cleaning agent.

4. The apparatus of claim 2, wherein said cleaning solution comprises about 60 parts water to one part chemical cleaning agent.

5. The apparatus of claim 1, wherein said tank is comprised of a material selected from the group consisting of a metal or a ceramic.

6. The apparatus of claim 1, wherein said tank is insulated by a material comprising a polymeric substance.

7. The apparatus of claim 1, wherein said heat source is comprised of at least one electrical heating element.

8. The apparatus of claim 1, wherein said control system includes a thermostat for controlling activation of said heat source.

9. The apparatus of claim 1, wherein said temperature range is substantially within the range of 140° F. to 180° F.

10. The apparatus of claim 1, wherein said value is substantially 170° F.

11. The apparatus of claim 1, wherein said time period is substantially within the range of one minute to twelve hours.

12. The apparatus of claim 1, wherein said time period is substantially four hours.

13. The apparatus of claim 1, further comprising a pump for circulating said cleaning solution.

14. The apparatus of claim 1, wherein said articles are dried by natural air convection after cleaning of said articles is complete.

15. The apparatus of claim 14, wherein said drying is accomplished by draining said cleaning solution from said tank.

16. The apparatus of claim 1, wherein said temperature lies below the atmospheric boiling point of said cleaning solution.

* * * * *